US012496489B1

(12) United States Patent
Fiocchi

(10) Patent No.: US 12,496,489 B1
(45) Date of Patent: Dec. 16, 2025

(54) SWING TRAINING ASSEMBLIES AND METHODS OF SWING TRAINING USING SWING TRAINING ASSEMBLIES

(71) Applicant: Lee Fiocchi, Houston, TX (US)

(72) Inventor: Lee Fiocchi, Houston, TX (US)

( * ) Notice: Subject to any disclaimer, the term of this patent is extended or adjusted under 35 U.S.C. 154(b) by 0 days.

(21) Appl. No.: 19/177,567

(22) Filed: Apr. 13, 2025

(51) Int. Cl.
*A63B 22/00* (2006.01)
*A63B 21/16* (2006.01)

(52) U.S. Cl.
CPC ..... *A63B 22/0002* (2013.01); *A63B 21/169* (2015.10); *A63B 2208/0204* (2013.01); *A63B 2214/00* (2020.08)

(58) Field of Classification Search
CPC . A63B 21/169; A63B 22/0002; A63B 69/331; A63B 2208/0204; A63B 2214/00
See application file for complete search history.

(56) References Cited

U.S. PATENT DOCUMENTS 3,502,330 A 3/1970 Cheftel
4,082,271 A * 4/1978 Martin ..... A63B 69/0097 473/435
4,140,313 A * 2/1979 Martin ..... A63B 69/0097 473/434
4,153,246 A * 5/1979 Byrne ..... A63B 63/00 160/113
4,241,914 A * 12/1980 Bushnell ..... A63B 21/00181 482/130
4,417,728 A * 11/1983 Hay ..... A63B 63/00 273/342
4,703,931 A * 11/1987 Steen ..... A63B 69/0097 473/197
4,842,035 A * 6/1989 Thompson ..... E04B 2/7431 160/351
5,026,065 A * 6/1991 Bellagamba ..... A63B 69/36211 473/216
7,153,245 B2 * 12/2006 Kim ..... A63B 21/156 473/409
7,727,131 B2 * 6/2010 Longo ..... A63B 21/0552 482/121

(Continued)

FOREIGN PATENT DOCUMENTS

CN 111672052 A 9/2020

OTHER PUBLICATIONS

Web page from www.berg.com.
Image of wall-mounted punching bag.

*Primary Examiner* — Joshua Lee
(74) *Attorney, Agent, or Firm* — My Idea Law PLLC; Nathan Q. Huynh

(57) ABSTRACT

Disclosed herein are methods for swing training that may include: providing a swing training assembly that may include: a frame that may include: a first frame portion disposed on a first plane, wherein the first plane has a front side and a rear side; a second frame portion that is coplanar with the first frame portion; a third frame portion coupled to the first frame portion and the second frame portion; and a fourth frame portion disposed adjacent to the rear side of the first plane, the fourth frame portion having a U-shape portion; and a band extending at least from the first frame portion to the second frame portion; swinging a human arm laterally against the band; and disposing a portion of the human arm within the U-shape portion.

20 Claims, 9 Drawing Sheets

(56) References Cited

U.S. PATENT DOCUMENTS

| | | | | |
|---|---|---|---|---|
| 7,828,296 | B2 * | 11/2010 | Crawley | A63B 69/0097 273/400 |
| 9,889,363 | B1 * | 2/2018 | Myrick | A63B 21/0442 |
| 10,589,164 | B2 * | 3/2020 | Lennon | A63B 71/022 |
| 10,946,261 | B2 | 3/2021 | Arredondo | |
| 11,504,569 | B2 * | 11/2022 | Hoover | A63B 23/03525 |
| 2005/0272576 | A1 | 12/2005 | Simmons | |
| 2010/0130333 | A1 * | 5/2010 | Strong | A63B 71/023 482/83 |
| 2020/0289874 | A1 * | 9/2020 | Sanders | A63B 21/4023 |
| 2022/0257990 | A1 * | 8/2022 | Hetrick | A63B 21/02 |

* cited by examiner

SWING TRAINING ASSEMBLIES AND METHODS OF SWING TRAINING USING SWING TRAINING ASSEMBLIES

BACKGROUND

1. Field of Inventions

The field of this application and any resulting patent is swing training assemblies and methods of swing training using swing training assemblies.

2. Description of Related Art

Various swing training assemblies and methods of swing training using swing training assemblies have been proposed including prior art listed on this patent. However, those assemblies and methods lack the combination of steps and/or features of the assemblies and methods claimed herein. Furthermore, it is contemplated that the assemblies and/or methods disclosed herein, including those claimed, solve at least some of the problems those prior art assemblies and methods have failed to solve. Also, it is contemplated that the assemblies and/or methods claimed herein have benefits that would be surprising and unexpected to a hypothetical person of ordinary skill with knowledge of the prior art existing as of the filing date of this application.

SUMMARY

The disclosure herein includes a method of swing training that may include: providing a swing training assembly that may include: a frame that may include: a first frame portion disposed on a first plane, the first plane having a front side and a rear side; a second frame portion that is coplanar with the first frame portion; a third frame portion coupled to the first frame portion and the second frame portion; and a fourth frame portion coupled to the first frame portion and the second frame portion, the fourth frame portion having a U-shape; and a band having a first band portion coupled to the first frame portion, a second band portion coupled to the second frame portion, and a middle band portion extending from the first frame portion to the second frame portion; swinging a human arm laterally against the middle band portion; and disposing a portion of the human arm within the fourth frame portion.

Additionally, the disclosure herein includes a method of swing training that may include: providing a swing training assembly that may include: a frame that may include: a first frame portion disposed on a first plane, wherein the first plane has a front side and a rear side; a second frame portion that is coplanar with the first frame portion; a third frame portion coupled to the first frame portion and the second frame portion; and a fourth frame portion disposed adjacent to the rear side of the first plane, the fourth frame portion having a U-shape portion; and a band extending at least from the first frame portion to the second frame portion; swinging a human arm laterally against the band; and disposing a portion of the human arm within the U-shape portion.

Also, the disclosure herein includes a method of swing training that may include: providing a swing training assembly that may include: a frame that may include: a front side; a rear side; a first frame portion having a first frame crossbar, a first frame first arm perpendicular to the first frame crossbar, a first frame second arm perpendicular to the first frame crossbar; a second frame portion having a second frame crossbar parallel to the first frame crossbar, a second frame first arm extending towards the first frame first arm, and a second frame second arm extending towards the first frame second arm; a third frame portion disposed on the rear side of the frame and having a third frame crossbar extending a first distance from first frame portion to the second frame portion, a third frame first arm, a third frame second arm; a fourth frame portion disposed on the rear side of the frame and having a fourth frame crossbar parallel to the third frame crossbar, a fourth frame first arm perpendicular to the fourth frame crossbar, a fourth frame second arm perpendicular to the fourth frame crossbar; and a band having a first band portion coupled to the first frame crossbar, a second band portion coupled to the second frame crossbar, and a middle band portion extending from the first frame crossbar to the second frame crossbar; swinging a human arm laterally against the middle band portion; and disposing a portion of the human arm between the fourth frame first arm and the fourth frame second arm.

In addition, the disclosure herein includes a swing training assembly that may include: a frame that may include: a first frame portion having a first frame crossbar, a first frame first arm perpendicular to the first frame crossbar, a first frame second arm perpendicular to the first frame crossbar, wherein the first frame first arm and the first frame second arm may be disposed a first distance apart; a second frame portion having a second frame crossbar, a second frame arm perpendicular to the second frame crossbar, a second frame arm perpendicular to the crossbar, wherein a distance between the second frame first arm and the second frame second arm is equal to the first distance; a third frame portion having a third frame crossbar, a third frame first arm perpendicular to the third frame crossbar, a third frame second arm perpendicular to the third frame crossbar; and a fourth frame portion having a fourth frame crossbar, a fourth frame first arm perpendicular to the fourth frame crossbar, a fourth frame second arm perpendicular to the fourth frame crossbar; a first ratchet couple to the first arm and the second arm of the first frame portion; a first ratchet couple to the first arm and the second arm of the second frame portion; a band having a first portion coupled to the first ratchet and a second portion coupled to the second ratchet, wherein the band may be disposed over the first frame crossbar and the second frame crossbar.

Furthermore, the disclosure herein includes a swing training assembly that may include: a frame that may include: a first frame portion disposed on a first plane, the first plane having a front side and a rear side; a second frame portion that is coplanar with the first frame portion; a third frame portion disposed on a second plane perpendicular to the first plane and disposed on a rear side of the first frame portion; and a fourth frame portion disposed on a third plane parallel to the second plane and disposed on a rear side of the first frame portion and the second frame; a first ratchet couple to the first frame portion; a band having a first band portion coupled to the first ratchet and middle band portion disposed on front side of the first frame portion and the second frame portion.

Moreover, the disclosure herein includes a swing training assembly that may include: a frame that may include: a first frame portion disposed on a first plane, the first plane having a front side and a rear side; a second frame portion that is coplanar with the first frame portion; a third frame portion disposed on a second plane perpendicular to the first plane and disposed on a rear side of the first frame portion; and a fourth frame portion disposed on a third plane parallel to the second plane and disposed on the rear side of the first frame portion and the second frame portion; a first ratchet couple to the first frame portion; a band having a first band portion coupled to the first ratchet and middle band portion disposed on front side of the first frame portion and the second frame portion. A swing training assembly that may include: a frame that may include: a first frame portion disposed on a first plane; a second frame portion that is coplanar with the first frame portion; a third frame portion coupled to the first frame portion and the second frame portion; and a fourth frame portion disposed adjacent to the rear side of the first plane, the fourth frame portion having a U-shaped portion, wherein the first frame portion and the second frame portion may be disposed on first plane and the fourth frame portion is disposed on a second plane that is perpendicular to the first plane; and a first ratchet couple to the first frame portion; a band having a first band portion coupled to the first ratchet and middle band portion parallel to the second plane.

DETAILED DESCRIPTION

1. Introduction

Figure 1A:
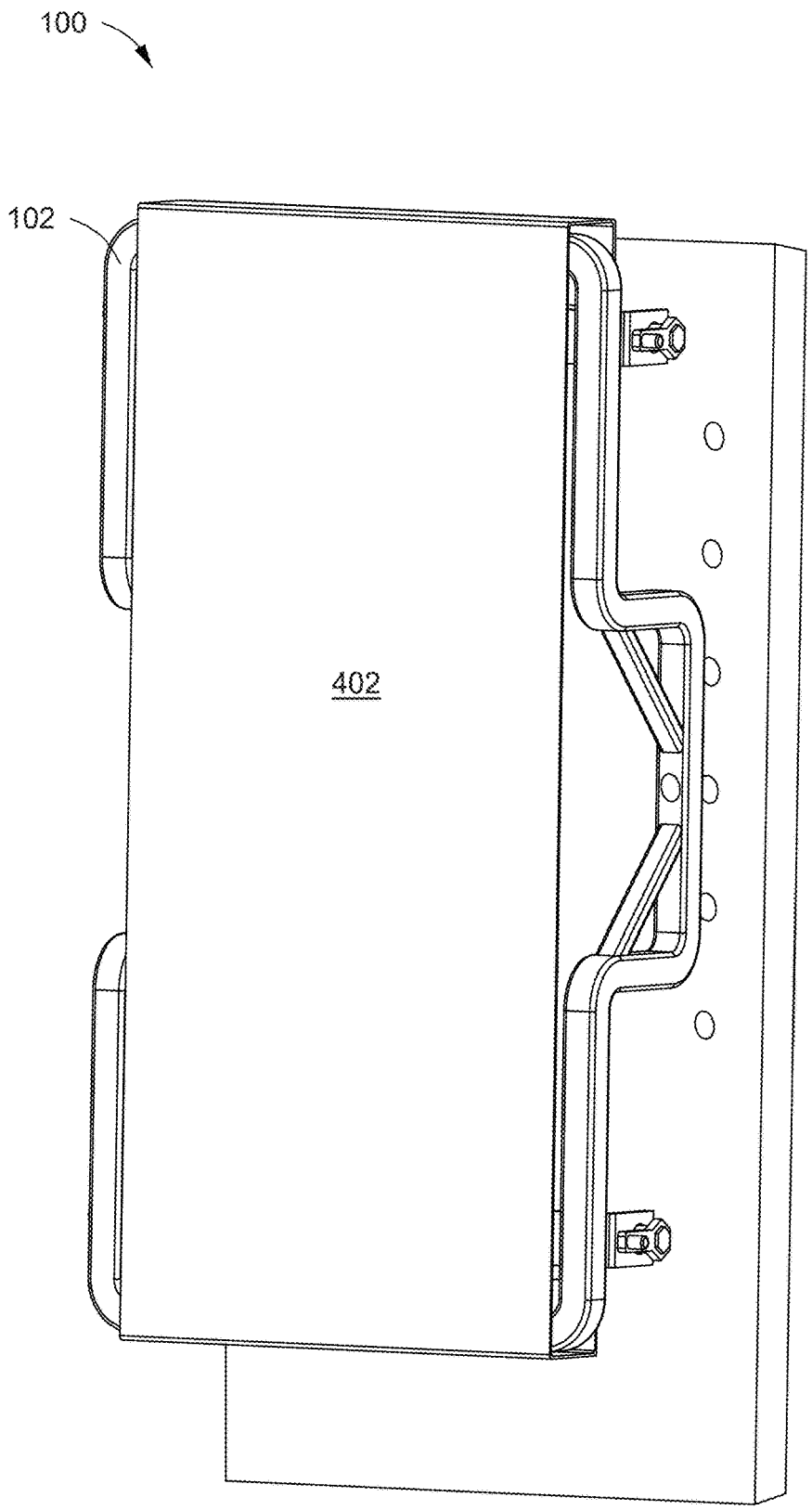
FIG. 1A is an illustration of a perspective view of a swing training assembly that includes a frame, and a band coupled to the frame.

A detailed description will now be provided. The purpose of this detailed description, which includes the drawings, is to satisfy the statutory requirements of 35 U.S.C. § 112. For example, the detailed description includes a description of inventions defined by the claims and sufficient information that would enable a person having ordinary skill in the art to make and use the inventions. In the figures, like elements are generally indicated by like reference numerals regardless of the view or figure in which the elements appear. The figures are intended to assist with the description and to provide a visual representation of certain aspects of the subject matter described herein. The figures are not all necessarily drawn to scale, nor do they show all the structural details, nor do they limit the scope of the claims.

Each of the appended claims defines a separate invention which, for infringement purposes, is recognized as including equivalents of the various elements or limitations specified in the claims. Depending on the context, all references below to the "invention" may in some cases refer to certain specific embodiments only. In other cases, it will be recognized that references to the "invention" will refer to the subject matter recited in one or more, but not necessarily all, of the claims. Each of the inventions will now be described in greater detail below, including specific embodiments, versions, and examples, but the inventions are not limited to these specific embodiments, versions, or examples, which are included to enable a person having ordinary skill in the art to make and use the inventions when the information in this patent is combined with available information and technology. Various terms as used herein are defined below, and the definitions should be adopted when construing the claims that include those terms, except to the extent a different meaning is given within the specification or in express representations to the Patent and Trademark Office (PTO). To the extent a term used in a claim is not defined below or in representations to the PTO, it should be given the broadest definition persons having skill in the art have given that term as reflected in at least one printed publication, dictionary, or issued patent.

2. Selected Definitions

Certain claims include one or more of the following terms which, as used herein, are expressly defined below.

The term "adjacent" as used herein means next to and may include physical contact but does not require physical contact.

The term "band" as used herein is defined as a flexible structure that has a long side and at least one short side and configured to have portions capable of being coupled to respective portions of a frame. A band may be rectangular in cross-section, as illustrated in some of the drawings. A band may be continuous, or it may have two ends. A band may be constructed from any one of various textiles, e.g., rubber, silicone rubber, Kevlar, fabric, cotton, linen, plastic, nylon, polyester, and/or leather. A band may be folded into two or more adjacent portions or segments. Certain bands disclosed herein may have segments folded into plies that are sutured together. A band may have a flap extending therefrom.

The term "aperture" as used herein is defined as any opening in a solid object or structure. For example, an aperture may be an opening that begins on one side of the solid object and ends on the other side of the object. An aperture may alternatively be an opening that does not pass entirely through the object, but only partially passes through, e.g., a groove. An aperture can be an opening in an object that is completely circumscribed, defined, or delimited by the object itself. Alternatively, an aperture can be an opening in the object formed when the object is combined with one or more other objects or structures. One or more apertures may be disposed and pass entirely through a frame portion, a support post, a wall, and/or a drum of ratchet. An aperture may receive another object and permit ingress and/or egress of the object through the aperture. For example, a groove disposed through a drum may receive one or ends of one or more bands.

The term "assembly" as used herein is defined as any set of components that have been fully or partially assembled together. A group of assemblies may be coupled to form a combined assembly, e.g., a body having an inner surface and an outer surface.

The term "colinear" as used herein is defined as being disposed on a single line. Two structures are colinear if they have respective central axes that lay on a single geometric line.

The term "frame" as used herein is defined as a structure, preferably a cylindrical structure, preferably configured to have a band extend from a first end the structure to a second end of the structure. The term "coupled" as used herein is defined as directly or indirectly connected, attached, or integral with, e.g., part of. A first object may be coupled to a second object such that the first object is positioned at a specific, or pre-determined, location and orientation with respect to the second object. For example, a ratchet may be coupled to frame. A first object may be either permanently or removably coupled to a second object. Two objects may be "permanently coupled" to each other via adhesive or welding; or they may be "removably coupled" via collets, screws, threading, or nuts and bolts such that they are capable of being easily separated and no longer coupled. Thus, a portion of a band may be removably coupled to a ratchet such that the portion of the band may then be uncoupled and removed from the ratchet. Two objects may be "rotatably coupled," e.g., when one object is coupled to another object and one of the objects remains free to rotate about the other or rotate in place. For example, a drum is rotatably coupled to a bracket of a ratchet.

The term "cylindrical" as used herein is defined as shaped like a cylinder, e.g., having straight parallel sides and a circular or oval or elliptical cross-section. A cylindrical body or structure, e.g., frame or drum, may be completely or partially shaped like a cylinder. A cylindrical body, e.g., drum, which has an outer diameter that changes abruptly may have a radial face or "lip" extending toward the center axis. A cylindrical body may have an aperture that extends through the entire length of the body to form a hollow cylinder that is capable of permitting fluid to pass through, e.g., water or hydrocarbon. On the other hand, a cylindrical structure may be solid, e.g., drum, rod, or peg.

The term "disposed" as used herein means having been put, placed, positioned, inserted, or oriented in a particular location. For example, when an aperture occupies a position within a drum, the aperture is disposed in or within the drum. Also, a portion of a band may be disposed in or disposed through an aperture in a drum.

The term "drum" as used herein is defined as a structure, preferably a cylindrical structure, preferably configured to have a portion of a band coupled there to. A drum may have an aperture extending from one side of the drum through an opposite side of the drum. A drum may be part of a ratchet.

The term "elbow" as used herein is defined as a joint between two object or structure that forms an angle less than 180°. An elbow may be 90°. Preferably, an elbow is curved, e.g., rounded or radius. metal, Structures disclosed herein that have elbows may be constructed from metal, carbon fiber, fiber glass, plastics, or wood. Accordingly, such structures may have a benefit of flexibility because portions of those structures may return to their original position despite having respective ends of those portions being moved away or towards each other. In that case, the elbow does not become cracked or damaged. A crossbar and an arm of a frame portion may be joined at an elbow. Two respective arms of two frame portions may be joined at an elbow.

The terms "first," "second," "third," and other ordinal terms, when used to refer to certain things, e.g., structures, are terms that differentiate those things from one another and do not mean or imply anything in terms of importance, sequence, etc.

The term "frame" as used herein is defined as a structure, preferably a cylindrical structure, preferably configured to have a band extend from a first end the structure to a second end of the structure. A frame may have an upper frame portion and a lower frame portion. A frame may have a frame portion that is bent at 90° at least in two places such that one or more frame portions have shapes of a block-letter "U." A portion of a human forearm may be disposed within the open space of the U-shaped frame portion.

The term "handle" as used as a noun herein is defined as a structure, preferably a cylindrical structure, configured to be gripped by a human hand. A handle may be coupled to a drum of a ratchet. A handle may be rotatably coupled to a bracket of a ratchet.

The terms "he," "she," "they," and any other personal pronouns as used herein refer to any gender interchangeably. For example, all uses of "he" encompasses "she" as well.

The term "pivot" as used as a verb herein is defined as turn, e.g., move, rotate, swivel, revolve, and/or spin around a point. After any pivoting takes place with an object, the object may be "pivoted."

The term "perpendicular" as used herein is defined as at an angle ranging from 85° or 88 to 92° or 95°. Two structures that are perpendicular to each other may be orthogonal and/or tangential to each other.

The term "plane" as used herein is defined as a flat, two-dimensional surface that extends infinitely in all directions. A plane has no curvature. A plane may have a flat front side and a flat rear side. Because a plane extends indefinitely, any plane referred to herein is depicted in the drawings as a rectangle or a square delimited by dash lines. An object or structure is said to be "disposed on a plane" if three or more points on the object or structure lies on the plane and those three or more points are vertices of a polygon on the plane. For example, a first arm, a second arm, and a crossbar of a U-shaped frame portion are said to be disposed on a plane when the first arm has first point, the second arm has a second a point, and the crossbar has a third point, and the first point, the second point, and the third point all lay on a plane and are vertices of a triangle on the plane. An object or structure disposed on a plane may be aligned with that plane. Two are "coplanar" if both structures are disposed on a single plane. Two planes are parallel if they have no points of intersection. Two planes are perpendicular if they intersect at substantially 90°.

The term "providing" as used herein is defined as making available, furnishing, supplying, equipping, or causing to be placed in position.

The term "space" as used herein means any volumetric space. For example, it may refer to some empty volume between two objects, structures, points, lines, edges, or surfaces, i.e., not occupied by anything solid. A non-limiting example of space is the empty volume between a first arm, a second arm, and a crossbar of a U-shaped frame portion.

The term "surface" as used herein is defined as any boundary of a structure. A surface may also refer to that cylindrical area that extends radially around a cylinder which may, for example, be part of a plug or valve. A surface may also refer to that cylindrical area that extends radially around a cylinder which may, for example, be part of a frame, a band, or a drum. A "surface" may have any geometry, e.g., curved or flat. A surface may have irregular contours. A surface may be formed from components, e.g., frame portions, band, and/or ratchets, coupled together. Coupled components may form irregular surfaces.

The term "unitary" as used herein means having the nature, properties, or characteristics of a single unit. For example, a drum and a spur may be unitary where they are connected, directly or indirectly, and fulfill the intended purpose of being rotated. Also, U-shaped frame portions may be unitary where they are connected, directly or indirectly, and fulfill the intended purpose of being a structure on which a middle portion of a band may be coupled to.

The terms "upper", "lower," "top," and "bottom as used herein are relative terms describing the position of one object, thing, or point positioned in its intended useful position, relative to some other object, thing, or point also positioned in its intended useful position, when the objects, things, or points are compared to distance from the center of the earth. For example, the term "upper" identifies any object or part of a particular object that is farther away from the center of the earth than some other object or part of that particular object, when the objects are positioned in their intended useful positions. The term "lower" identifies any object or part of a particular object that is closer to the center of the earth than some other object or part of that particular object, when the objects are positioned in their intended useful positions. The term "top" as used herein means in the highest position, e.g., farthest from the ground. The term "bottom" as used herein means in the lowest position, e.g., closest the ground.

3. Certain Specific Embodiments

The disclosure herein includes a method of swing training that may include: providing a swing training assembly that may include: a frame that may include: a first frame portion disposed on a first plane, the first plane having a front side and a rear side; a second frame portion that is coplanar with the first frame portion; a third frame portion coupled to the first frame portion and the second frame portion; and a fourth frame portion coupled to the first frame portion and the second frame portion, the fourth frame portion having a U-shape; and a band having a first band portion coupled to the first frame portion, a second band portion coupled to the second frame portion, and a middle band portion extending from the first frame portion to the second frame portion; swinging a human arm laterally against the middle band portion; and disposing a portion of the human arm within the fourth frame portion.

Additionally, the disclosure herein includes a method of swing training that may include: providing a swing training assembly that may include: a frame that may include: a first frame portion disposed on a first plane, wherein the first plane has a front side and a rear side; a second frame portion that is coplanar with the first frame portion; a third frame portion coupled to the first frame portion and the second frame portion; and a fourth frame portion disposed adjacent to the rear side of the first plane, the fourth frame portion having a U-shape portion; and a band extending at least from the first frame portion to the second frame portion; swinging a human arm laterally against the band; and disposing a portion of the human arm within the U-shape portion.

Also, the disclosure herein includes a method of swing training that may include: providing a swing training assembly that may include: a frame that may include: a front side; a rear side; a first frame portion having a first frame crossbar, a first frame first arm perpendicular to the first frame crossbar, a first frame second arm perpendicular to the first frame crossbar; a second frame portion having a second frame crossbar parallel to the first frame crossbar, a second frame first arm extending towards the first frame first arm, and a second frame second arm extending towards the first frame second arm; a third frame portion disposed on the rear side of the frame and having a third frame crossbar extending a first distance from first frame portion to the second frame portion, a third frame first arm, a third frame second arm; a fourth frame portion disposed on the rear side of the frame and having a fourth frame crossbar parallel to the third frame crossbar, a fourth frame first arm perpendicular to the fourth frame crossbar, a fourth frame second arm perpendicular to the fourth frame crossbar; and a band having a first band portion coupled to the first frame crossbar, a second band portion coupled to the second frame crossbar, and a middle band portion extending from the first frame crossbar to the second frame crossbar; swinging a human arm laterally against the middle band portion; and disposing a portion of the human arm between the fourth frame first arm and the fourth frame second arm.

In addition, the disclosure herein includes a swing training assembly that may include: a frame that may include: a first frame portion having a first frame crossbar, a first frame first arm perpendicular to the first frame crossbar, a first frame second arm perpendicular to the first frame crossbar, wherein the first frame first arm and the first frame second arm may be disposed a first distance apart; a second frame portion having a second frame crossbar, a second frame arm perpendicular to the second frame crossbar, a second frame arm perpendicular to the crossbar, wherein a distance between the second frame first arm and the second frame second arm is equal to the first distance; a third frame portion having a third frame crossbar, a third frame first arm perpendicular to the third frame crossbar, a third frame second arm perpendicular to the third frame crossbar; and a fourth frame portion having a fourth frame crossbar, a fourth frame first arm perpendicular to the fourth frame crossbar, a fourth frame second arm perpendicular to the fourth frame crossbar; a first ratchet couple to the first arm and the second arm of the first frame portion; a first ratchet couple to the first arm and the second arm of the second frame portion; a band having a first portion coupled to the first ratchet and a second portion coupled to the second ratchet, wherein the band may be disposed over the first frame crossbar and the second frame crossbar.

Furthermore, the disclosure herein includes a swing training assembly that may include: a frame that may include: a first frame portion disposed on a first plane, the first plane having a front side and a rear side; a second frame portion that is coplanar with the first frame portion; a third frame portion disposed on a second plane perpendicular to the first plane and disposed on a rear side of the first frame portion; and a fourth frame portion disposed on a third plane parallel to the second plane and disposed on a rear side of the first frame portion and the second frame; a first ratchet couple to the first frame portion; a band having a first band portion coupled to the first ratchet and middle band portion disposed on front side of the first frame portion and the second frame portion.

Moreover, the disclosure herein includes a swing training assembly that may include: a frame that may include: a first frame portion disposed on a first plane, the first plane having a front side and a rear side; a second frame portion that is coplanar with the first frame portion; a third frame portion disposed on a second plane perpendicular to the first plane and disposed on a rear side of the first frame portion; and a fourth frame portion disposed on a third plane parallel to the second plane and disposed on the rear side of the first frame portion and the second frame portion; a first ratchet couple to the first frame portion; a band having a first band portion coupled to the first ratchet and middle band portion disposed on front side of the first frame portion and the second frame portion. A swing training assembly that may include: a frame that may include: a first frame portion disposed on a first plane; a second frame portion that is coplanar with the first frame portion; a third frame portion coupled to the first frame portion and the second frame portion; and a fourth frame portion disposed adjacent to the rear side of the first plane, the fourth frame portion having a U-shaped portion, wherein the first frame portion and the second frame portion may be disposed on first plane and the fourth frame portion is disposed on a second plane that is perpendicular to the first plane; and a first ratchet couple to the first frame portion; a band having a first band portion coupled to the first ratchet and middle band portion parallel to the second plane.

In any one of the assemblies or methods disclosed herein, the fourth frame portion may be adjacent to the rear side of the first plane.

In any one of the assemblies or methods disclosed herein, the fourth frame portion may be open at the middle band portion.

In any one of the assemblies or methods disclosed herein, a distance between the third frame portion and the fourth frame portion may be less than or equal to a width of the first frame portion or the second frame portion.

In any one of the assemblies or methods disclosed herein, a distance between the first frame portion and the second frame portion may be greater than or equal to a width of the fourth frame portion or the third frame portion.

Any one of the assemblies or methods disclosed herein may further include a ratchet coupled to the first frame portion or the first frame portion.

In any one of the assemblies or methods disclosed herein, the band may further include a second portion coupled to a ratchet that may be coupled to the frame.

In any one of the assemblies or methods disclosed herein, the middle band portion may extend from the first frame portion to the second frame portion.

In any one of the assemblies or methods disclosed herein, the middle band portion may be adjacent to an open side of the fourth frame portion.

In any one of the assemblies or methods disclosed herein, the fourth frame portion may include: a first arm; a second arm parallel to the first arm; a crossbar coupled to the first arm and the second arm; a first strut coupled to the first arm and the crossbar; and a second strut coupled to the second arm and the crossbar.

In any one of the assemblies or methods disclosed herein, the fourth frame portion may be coupled to the first frame portion and the second frame portion.

In any one of the assemblies or methods disclosed herein, the fourth frame portion may be open adjacent to the band.

In any one of the assemblies or methods disclosed herein, the U-shape portion may include: a crossbar having a first crossbar end and a second crossbar end; a first arm coupled to the first crossbar end and perpendicular to the crossbar; and a second arm coupled to the second crossbar end and parallel to the first arm.

In any one of the assemblies or methods disclosed herein, a distance between the third frame crossbar and the fourth frame crossbar may be equal to the first distance.

In any one of the assemblies or methods disclosed herein, a distance between the first frame portion and the second frame portion may equal to or greater than a length of the fourth frame crossbar.

In any one of the assemblies or methods disclosed herein, the first band portion may cover a portion of the first frame crossbar.

In any one of the assemblies or methods disclosed herein, the second band portion covers a portion of the second frame crossbar.

In any one of the assemblies or methods disclosed herein, the fourth frame portion may be disposed on a first side of the frame and the middle band portion may be disposed on a side of the frame, opposite the first side.

In any one of the assemblies or methods disclosed herein, a distance between the second plane and the third plane may be less than or equal to a width of the first frame portion or the second frame.

In any one of the assemblies or methods disclosed herein, the first ratchet may be adjacent to the rear side of the first plane.

Any one of the assemblies disclosed herein may further include a second ratchet couple to the second frame portion.

Any one of the assemblies disclosed herein may further include a second ratchet adjacent to the rear side of the first plane.

In any one of the assemblies or methods disclosed herein, when the middle band portion is struck with a human arm, the human arm would be capable of being disposed between portions of the fourth frame.

In any one of the assemblies disclosed herein, the band may further include a second portion coupled to the second ratchet.

In any one of the assemblies or methods disclosed herein, a portion of the middle band portion may be capable of being pushed past the first plane.

In any one of the assemblies or methods disclosed herein, the middle band portion may be disposed between the third plane and the fourth plane.

In any one of the assemblies or methods disclosed herein, the middle band portion may extend from the first frame portion to the second frame portion.

In any one of the assemblies or methods disclosed herein, the fourth frame portion may be coupled to the first frame portion and the second frame portion.

In any one of the assemblies or methods disclosed herein, the U-shaped portion may include: a first arm; a second arm parallel to the first arm; and a crossbar coupled to the first arm and the second arm.

In any one of the assemblies or methods disclosed herein, the U-shaped portion may include: a first arm; a second arm parallel to the first arm; a crossbar coupled to the first arm and the second arm; a first strut coupled to the first arm and the crossbar; and a second strut coupled to the second arm and the crossbar.

In any one of the assemblies or methods disclosed herein, the U-shaped portion may include: a first segment; a second segment; a first arm extending perpendicularly from the first segment; a second arm extending perpendicularly from the second segment; and a crossbar extending from the first arm to the second arm.

In any one of the assemblies or methods disclosed herein, the first segment may be colinear with the second segment.

In any one of the assemblies or methods disclosed herein, the crossbar may be parallel to the first segment.

In any one of the assemblies or methods disclosed herein, the crossbar may be parallel to the second segment.

In any one of the assemblies or methods disclosed herein, the crossbar may be disposed between the first segment and the second segment.

In any one of the assemblies or methods disclosed herein, the crossbar may be disposed between the first arm and the second arm.

In any one of the assemblies or methods disclosed herein, when the middle band portion may be struck by a human arm, the human arm would be capable of being disposed within the U-shaped portion.

In any one of the assemblies or methods disclosed herein, the U-shaped portion may be disposed on a first side of the frame and the middle band portion may be disposed on a second side of the frame opposite the first side.

4. Specific Embodiments in the Drawings

The drawings presented herein are for illustrative purposes only and do not limit the scope of the disclosure or claims. Rather, the drawings are intended to help enable one having ordinary skill in the art to make and use the systems and assemblies and practice the methods disclosed herein.

This section addresses specific versions of swing training assemblies shown in the drawings, which include assemblies, elements and parts that can be part of one or more swing training assemblies or methods for recirculating fluid. Although this section focuses on the drawings herein, and the specific embodiments found in those drawings, parts of this section may also have applicability to other embodiments not shown in the drawings. The limitations referenced in this section should not be used to limit the scope of the claims themselves, which have broader applicability than the structures disclosed in the drawings.

Figure 1B:
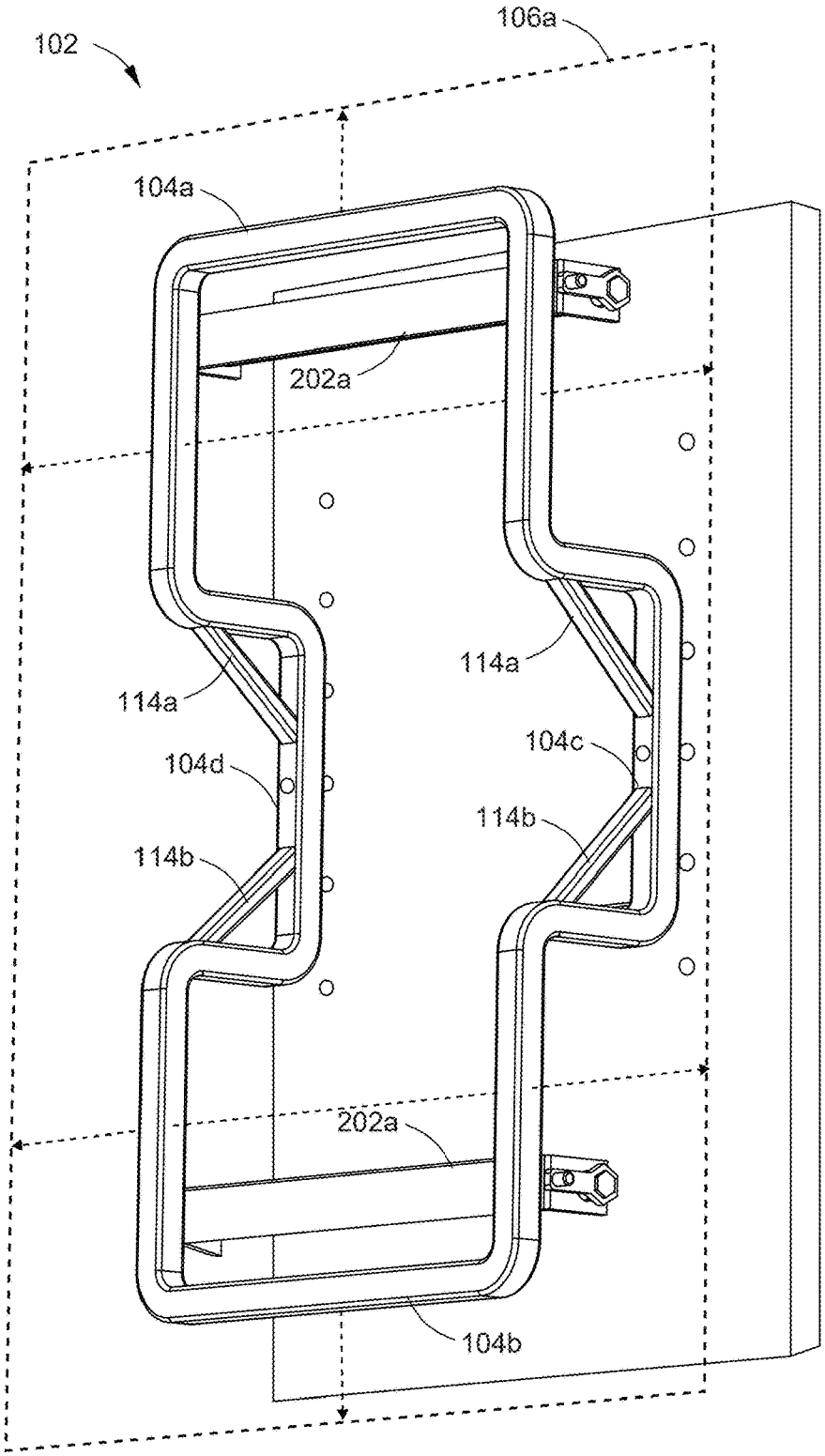
FIG. 1B is an illustration of a perspective view of the swing training assembly of FIG. 1A having a frame that is not covered by a band, in which portions of the frame are aligned with a first geometric plane.
Figure 1C:
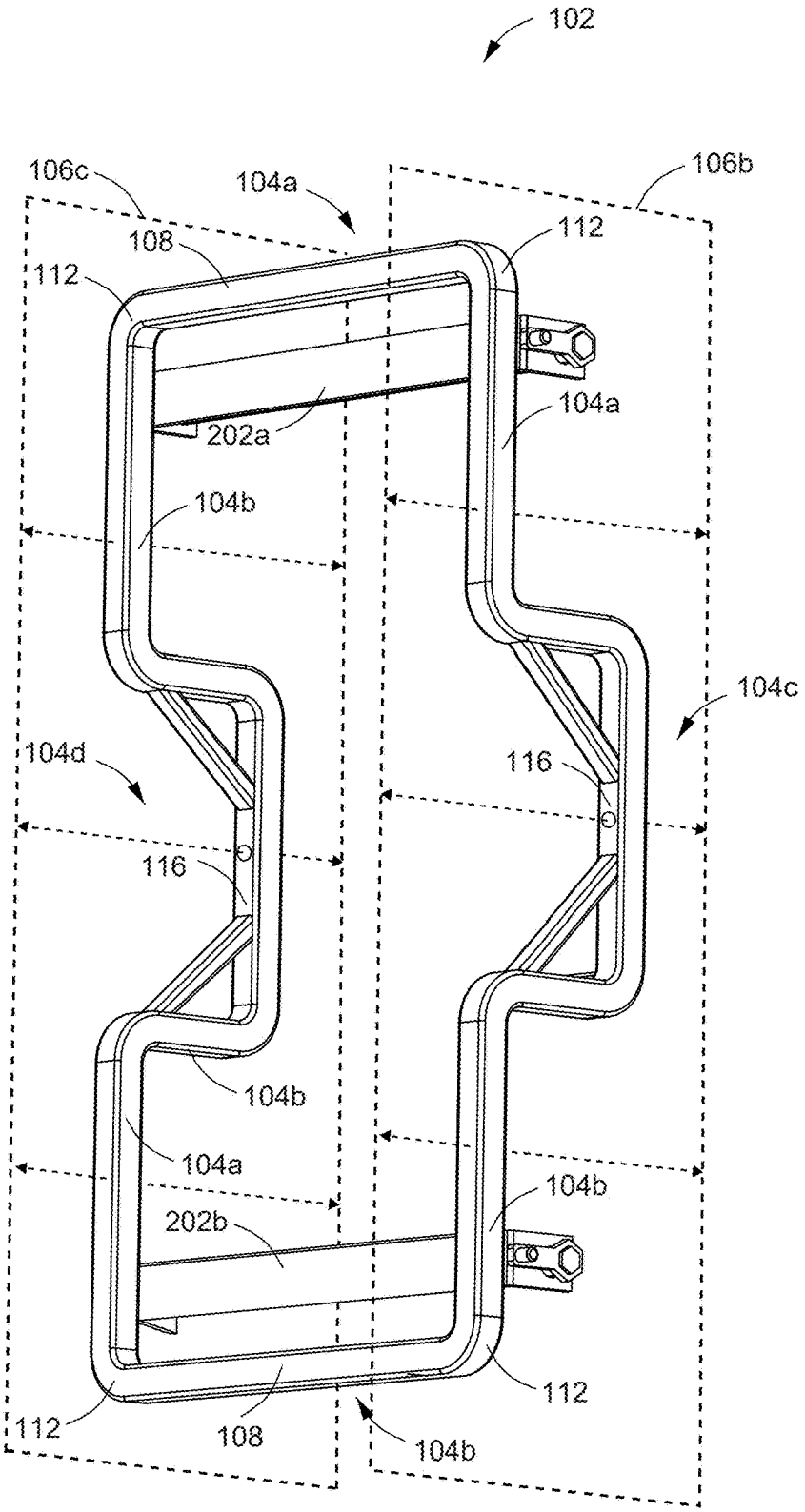
FIG. 1C is an illustration of a perspective view of the swing training assembly of FIG. 1A having a frame that is not covered by a band, in which portions of the frame are aligned with a second plane and a third plane, respectively.

FIG. 1A is an illustration of a perspective view of a swing training assembly 100 that includes a frame 102 and a band 402 coupled to the frame 102. The swing training assembly 100 may be coupled to a wall or a board. The frame 102 may be constructed from a unitary metallic pipe that is bent at multiple portions to form the shape shown in FIGS. 1B-C. Once the pipe is bent at the appropriate portions, the ends of the pipe may be coupled, e.g., welded, to create a continuous frame 102. In some cases, a frame may be injection molded. FIG. 1B is an illustration of a perspective view of the swing training assembly of FIG. 1A having a frame 102 that is not covered by a band 402, in which portions of the frame 102 is aligned with a first geometric plane 106*a*. FIG. 1C is an illustration of a perspective view of the swing training assembly of FIG. 1A having a frame 102 that is not covered by a band 402, in which portions of the frame 102 are aligned with a second plane 106*b* and a third plane 106*c*, respectively.

Referring to FIGS. 1A-C, a frame 102 has a first frame portion 104*a*, a second frame portion 104*b*, a third frame portion 104*c*, and a fourth frame portion 104*d*. Each frame portion 104 has the shape of an uppercase "U." Each frame portion 104 has a crossbar 108, a first arm 110*a*, and a second arm 110*b* that form three sides of the frame portion 104. The frame portion 104 has a fourth side that is open. In other words, the side of the U-shaped frame portion opposite the crossbar 108 is open, e.g., empty. Hence, a portion of a human arm may pass through the fourth side and enter an open portion of U-shaped frame. A width of the U-shaped frame portion may be a distance from the first arm 110*a* and the second arm 110*b*.

The crossbar 108, the first arm 110*a*, and the second arm 110*a* are coplanar. The first arm 110*a* and the second arm 110*b* are disposed on opposite ends of the crossbar 104. The arms 110*a-b* each extend from a respective end of the crossbar 108 in the same direction. The arms 110*a-b* are parallel to each other. Preferably, the arms 110*a-b* are positioned 90° relative to the crossbar 108. An elbow 112 is formed where each arm 110 meets the crossbar 108. Preferably, the elbow 112 is curved, e.g., radiused.

A first arm 110*a* of the first frame portion 104*a* and a second arm 110*b* of the second frame portion 104*b* extend towards each other. The first arm 110*a* of the first frame portion 104*a* and the second arm 110*b* of the second frame portion 104*b* may also be said to extend away from the third frame portion 104*c* towards respective crossbars 108. A second arm 110*b* of the first frame portion 104*a* and a first arm 110*a* of the second frame portion 104*b* also extend towards each other. The second arm 110*b* of the first frame portion 104*a* and the first arm 110*a* of the second frame portion 104*b* may also be said to extend away from the fourth frame portion 104*d*.

Additionally, a second arm 110*b* of the third frame portion 104*c* is coupled to the first arm 110*a* of the first frame portion 104*a*. A first arm 110*a* of the third frame portion 104*c* is coupled to the second arm 110*b* of the second frame portion 104*b*. Preferably, the second arm 110*b* of the third frame portion 104*c* and the first arm 110*a* of the first frame portion 104*a* are position 90° relative to each other. Moreover, the first arm 110*a* of the third frame portion 104*c* and the second arm 110*b* of the second frame portion 104*b* are also preferably positioned 90° relative to each other. An elbow 112 is formed where a first arm 110*a* and *s* second arm 110*b* respectively meet. Preferably, the elbow 112 is curved, e.g., radiused.

The first frame portion 104*a* and the second frame portion 104*b* are coplanar. In other words, the first frame portion 104*a* and the second frame portion 104*b* are disposed on a first plane 106*a* (shown by a rectangle with dotted lines in FIG. 1B). The first plane 106*a* has a front side and a rear side.

The third frame portion 104*c* and the fourth frame portion 104*d* are disposed adjacent to the rear side of the first plane 106*a*. In other words, the third frame portion 104*c* and the fourth frame portion 104*d* are closer to the rear side than the front of the plane 106*a*. The third frame portion 104*c* and the fourth frame portion 104*d* extend away from the plane 106*a* starting at or near the rear side of the plane 106*a*. The third frame portion 104*c* and the fourth frame portion 104*d* extend away from the rear side of the first plane 106*a*. The third frame portion 104*c* lay on a second plane 106*b* (shown by a rectangle with dotted lines in FIG. 1C). The fourth frame portion 104*d* lay on a third plane 106*c* (shown by a rectangle with dotted lines in FIG. 1C). The second plane 106*b* is perpendicular to the first plane 106*a*. The third plane 106*c* is also perpendicular to the first plane 106*a*. The second plane 106*b* and the third plane are parallel. Hence, the third frame portion 104*c* and the fourth frame portion 104*d* are parallel to each other. Accordingly, the third frame portion 104*c* and the fourth frame portion 104*d* are each perpendicular to the first plane 106*a*.

The third frame portion 104*c* and the fourth frame portion 104*d*, each includes struts 114. For each of the third frame portion 104*c* and the fourth frame portion 104*d*, a first strut 114*a* is coupled to a first portion of the crossbar 108 and the first arm 110*a*. A second strut 114*b* is coupled to a second portion of the crossbar 108 and the second arm 110*b*. Preferably, each strut 114 extends at 45° relative to the crossbar 108. Each strut 114 also extends at 45° from the respective arm 110 as well. The struts 114*a*, 114*b* inhibit the respective arms 110*a*, 18*b* from being moved towards or away from the crossbar 108. Thus, the respective struts 114*a*, 114*b* help the third frame portion 104*c* and the fourth frame portion 104*d* to retain their U-shapes.

Additionally, the swing training assembly 100 includes a first ratchet 202*a*, a second ratchet 202*b*, and an elastic band 402. The ratchets 202*a*, 202*b* are disposed below and/or behind the frame 102, e.g., on the rear side of the first plane 106*a*. The first ratchet 202*a* is coupled to the first frame portion 102*a*. The first ratchet 202*a* is parallel to a crossbar 108 of the first frame portion 104*a*. The second ratchet 202*b* is coupled to the second frame portion 104*b*. The second ratchet 202*b* is parallel to a crossbar 108 of the second frame portion 104*b*.

Referring to FIG. 1C, a first frame portion 104*a*, a second frame portion 104*b*, and third frame portion 104*c*, and a fourth frame portion 104*d* of the frame 102 may have an alternate description. The first frame portion 104*a* includes a cross bar 108. Ends of the crossbar 108 of the first frame portion are coupled to a segment, e.g., first arm 104*a*, of the third frame portion 104*c* and a segment, e.g., second arm 104*b*, of the fourth frame portion 104*d*, respectively. The second frame portion also includes a cross bar 108. Ends of the crossbar 108 of the second frame portion 104*b* are coupled to a segment, e.g., second arm 104*b*, of the third frame portion 104*c* and a segment, e.g., first arm 104*a*, of the fourth frame portion 104*d*, respectively. The first arm 104*a* and the second arm 104*b* of the third frame portion 104*c* are colinear. The third frame portion 104*c* has a U-shape portion coupled to the first arm 104*a* and the second arms 104*b* of the third frame portion 104*c*. The fourth frame portion 104*d* also has a U-shape portion coupled to the first arm 104*a* and the second arms 104*b* of the fourth frame portion 104*d*. The first arm 104*a* and the second arm 104*b* of the fourth frame portion 104*d* are colinear.

The segments and U-shape portion of the third frame portion 104*c* are disposed on a second plane 106*b*. The segments and U-shape portion of the fourth frame portion 104*d* are disposed on a third plane 106*c*. The second plane 106*b* and the third plane 106*c* are perpendicular to a first plane 106*a* (see FIG. 1B).

Figure 2A:
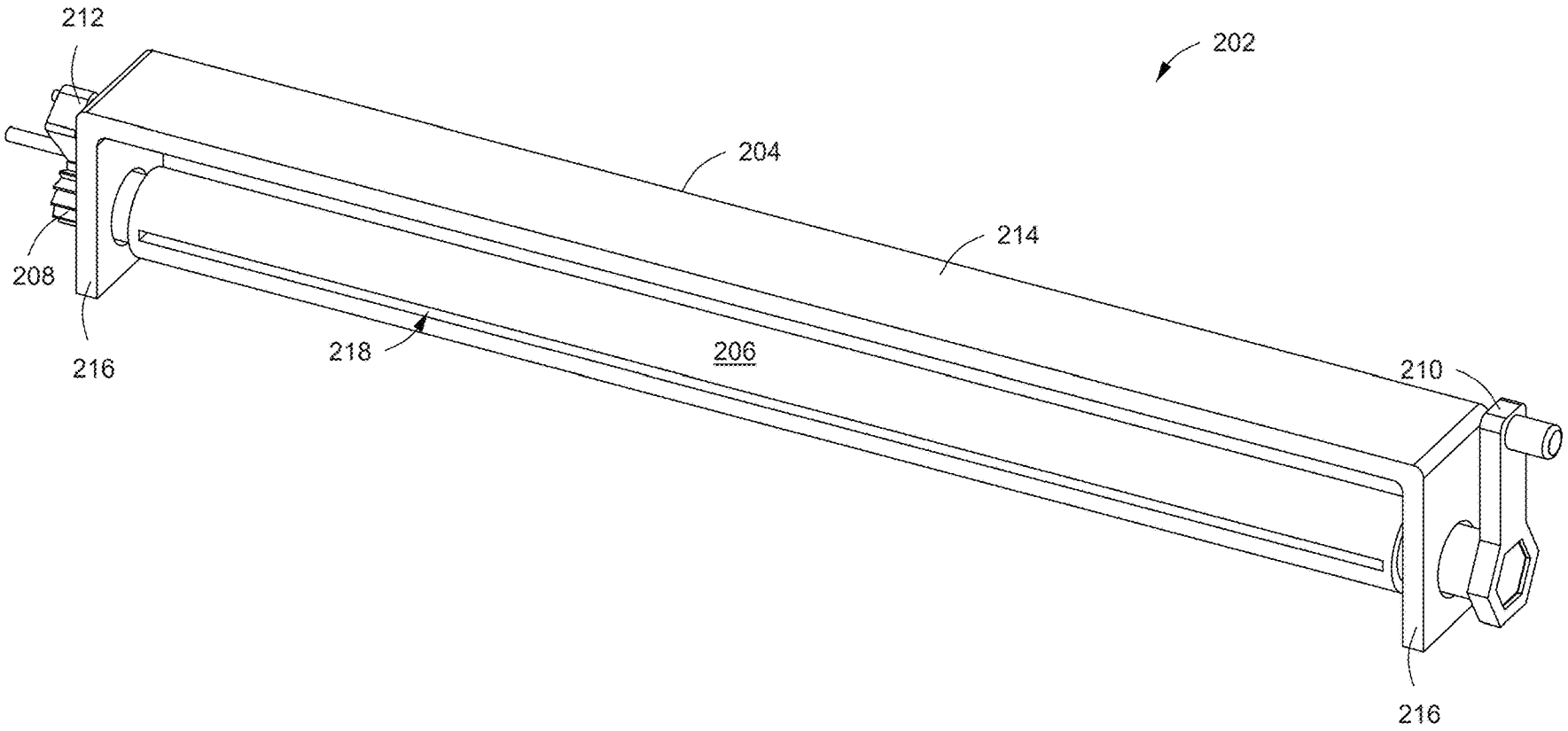
FIG. 2A is an illustration of a perspective view of a ratchet having a handle displayed in the foreground.
Figure 2B:
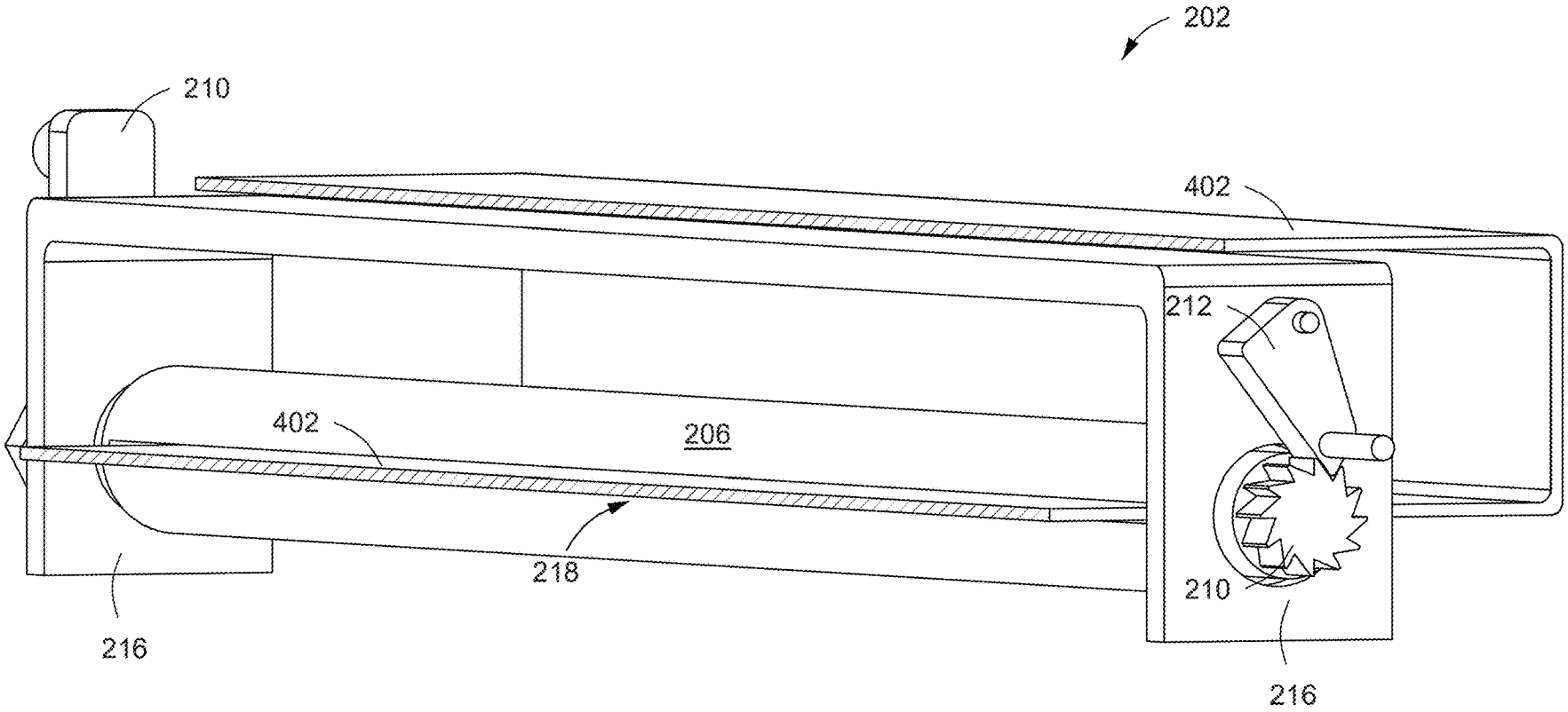
FIG. 2B is an illustration of a perspective view of a ratchet that includes a spur and a latch displayed in the foreground.

FIG. 2A is an illustration of a perspective view of a ratchet 202 that includes a handle 210 positioned in the foreground. FIG. 2B is an illustration of a perspective view of a ratchet 202 that includes a spur 208 positioned in the foreground.

Referring to FIG. 2A and FIG. 2B, a ratchet 202 includes a bracket 204, a cylindrical drum 206, a spur 208, a handle 210, and a latch 212. The bracket 204 is U-shaped. The bracket 204 has a central bracket portion 214 and two walls 216 extending perpendicular to the central bracket portion 214. Each wall 216 has an aperture disposed therethrough. The drum 206 has two ends respectively coupled to the two walls 216. Preferably, the two ends of the drum 206 extend through the respective apertures of the two walls 216. Accordingly, the drum 206 is rotatably coupled to the bracket 204. A first end of the drum 206 is coupled to a handle 210. Turning the handle 210 would rotate the drum 206.

Figure 2C:
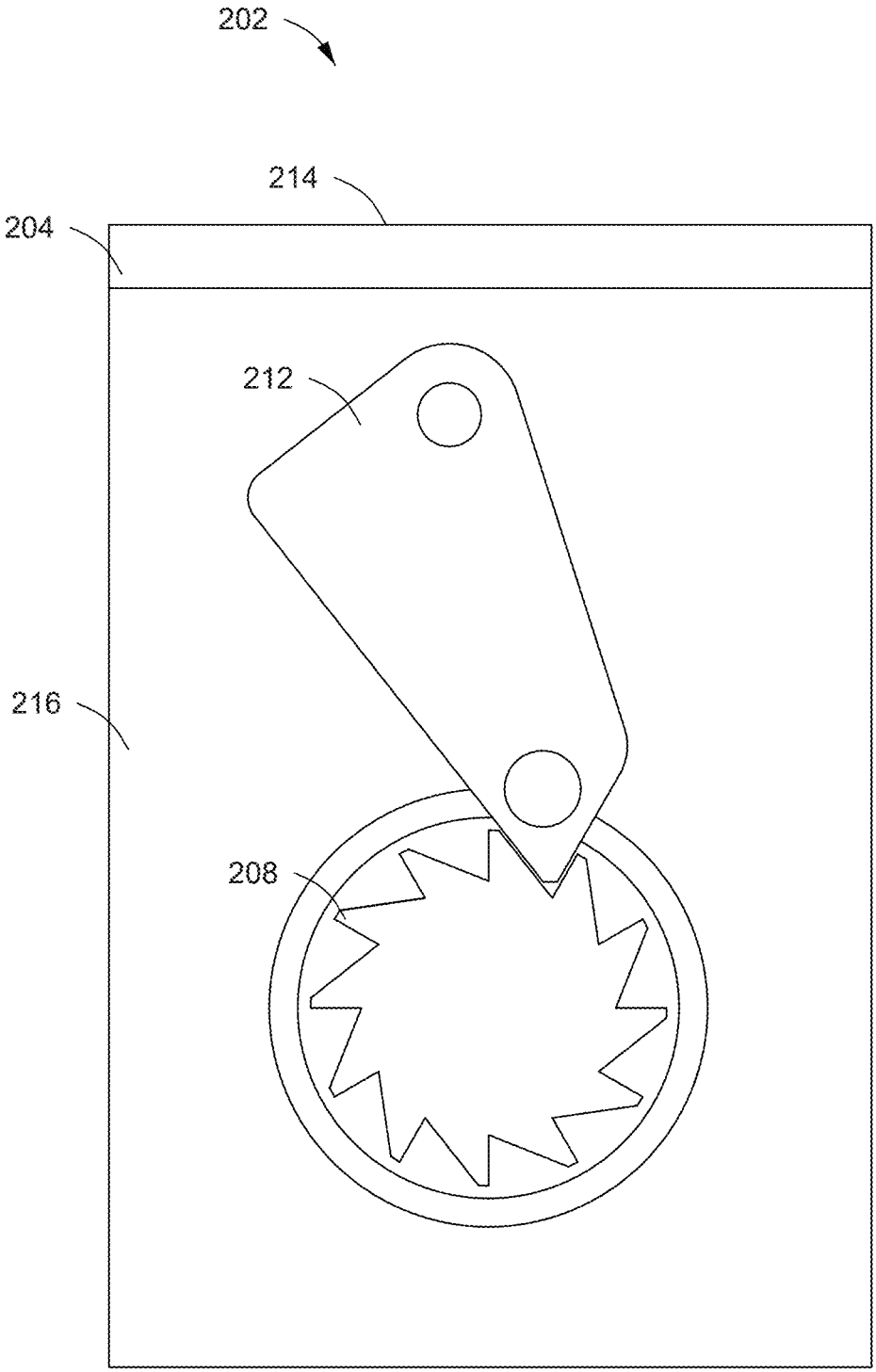
FIG. 2C is an illustration of a profile side view of a ratchet that includes a spur and a latch.

A spur 208 may be coupled, e.g., via a bolt, a screw, or welding, to a second end of the drum 206. In some cases, the spur 208 and the drum 206 may be unitary. As shown in FIG. 2C, the outer surface of the spur 208 may have teeth disposed thereon. One of the teeth may be abutted against a latch 212. The latch 212 is pivotably coupled, e.g. via a bolt, screw, or pin, to a wall 216 of a bracket 204. Additionally, the latch 212 is biased, e.g., via a coil or elastic band (not shown), against the spur 208. Hence, the biased latch 212 is abutted against a tooth of the spur 208. When the latch 212 is abutted against a tooth of the spur 208, the drum 206 is inhibited from rotating in a first direction, e.g., counterclockwise. However, the drum 206 is capable of being rotated, e.g., via the handle 210, in a second direction, e.g., clockwise.

Figure 2D:
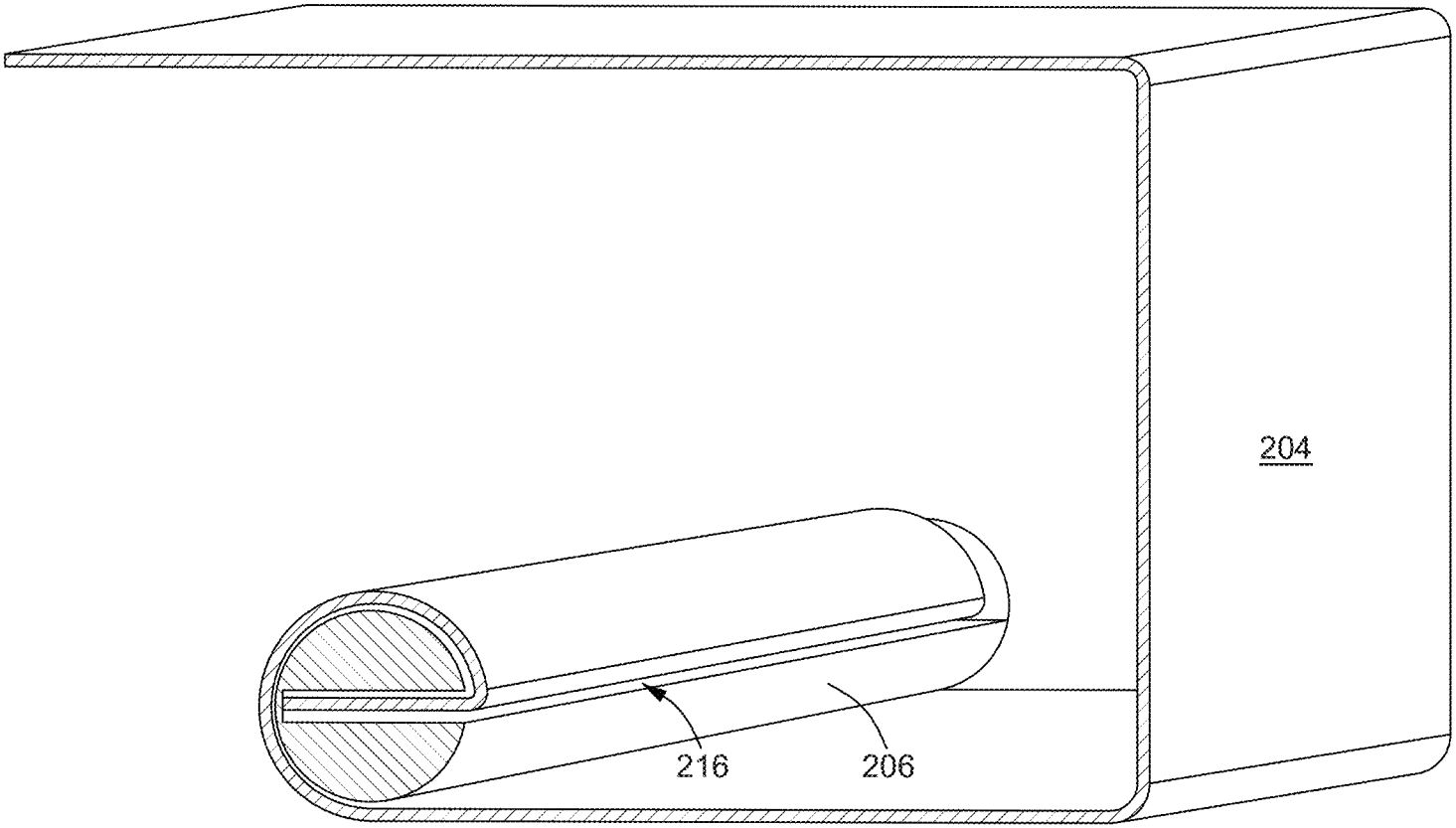
FIG. 2D is an illustration of a perspective cross-sectional view of a portion of a band wrapped around a drum.

FIG. 2D is an illustration of a perspective cross-sectional view of an elastic band 402 coupled to a drum 206 of a ratchet 202. The drum 206 has an aperture 218 disposed along a length of the drum 206. Additionally, the aperture 218 extends radially into the drum 206. In some cases, the aperture 216 extends only partially radially into the drum 206. Preferably, the aperture 218 extends from one side of the drum 206 through its central axis and then through an opposite side of the drum 206.

An end of the band 402 is disposed through the aperture 218 of the drum 206. Winding, e.g., rotating, the drum 206 in a clockwise direction with the handle 210 (see FIG. 2C), wraps the band 402 around the drum 206. As the band 402 wraps around the drum 206, the band 402 may tighten around the drum 206. Furthermore, the band 402 would wrap around the portion of the band 402 disposed in the aperture 218. Friction from the tightened band 402 around portions of itself and the drum 218 would hold that portion in place in the aperture 218. Hence, in some cases, the end of the band 402 disposed inside the aperture 218 may be inhibited from exiting the aperture 218.

Figure 3:
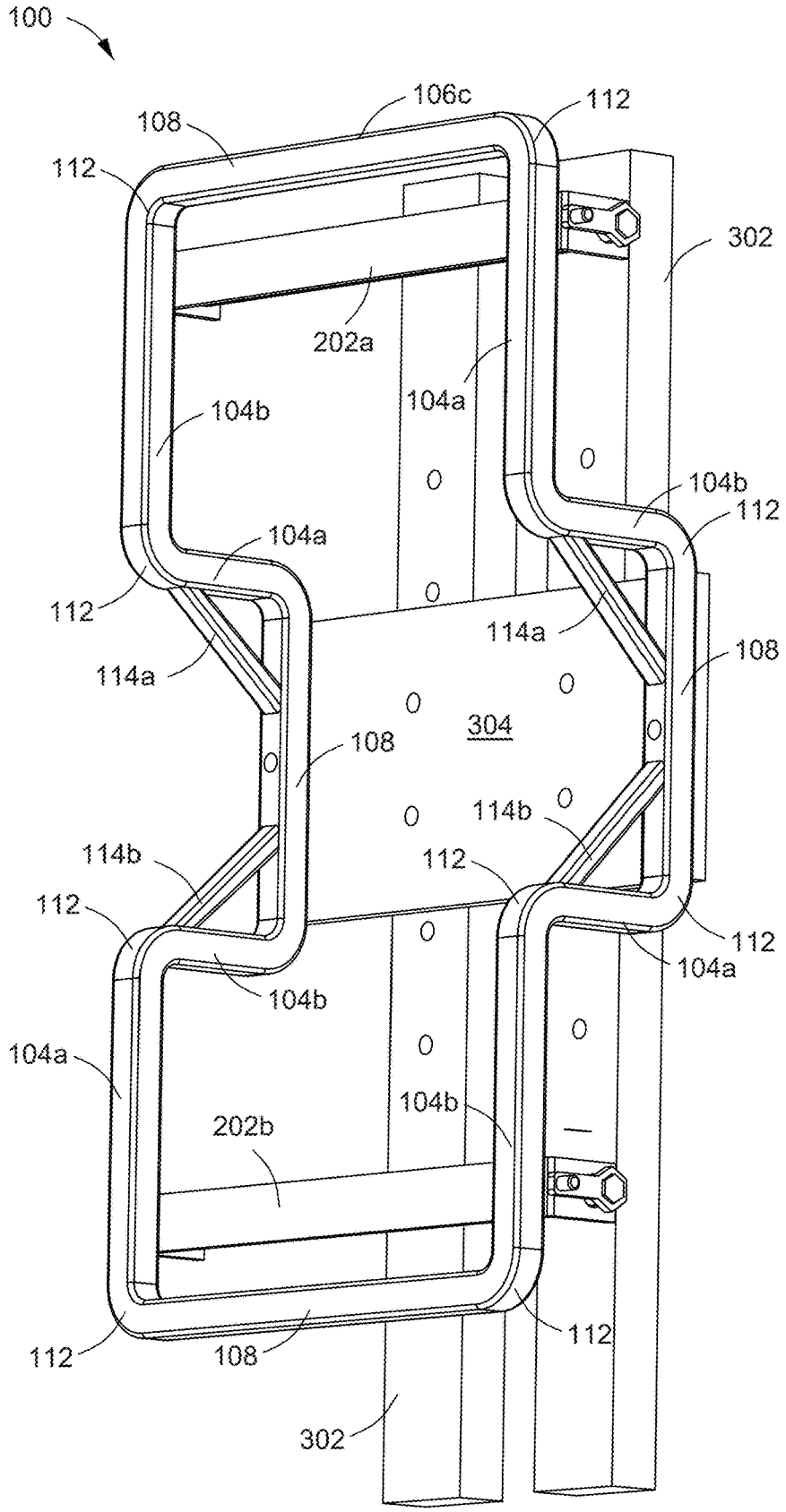
FIG. 3 is an illustration of a perspective view of a swing training assembly coupled to support posts.
Figure 4:
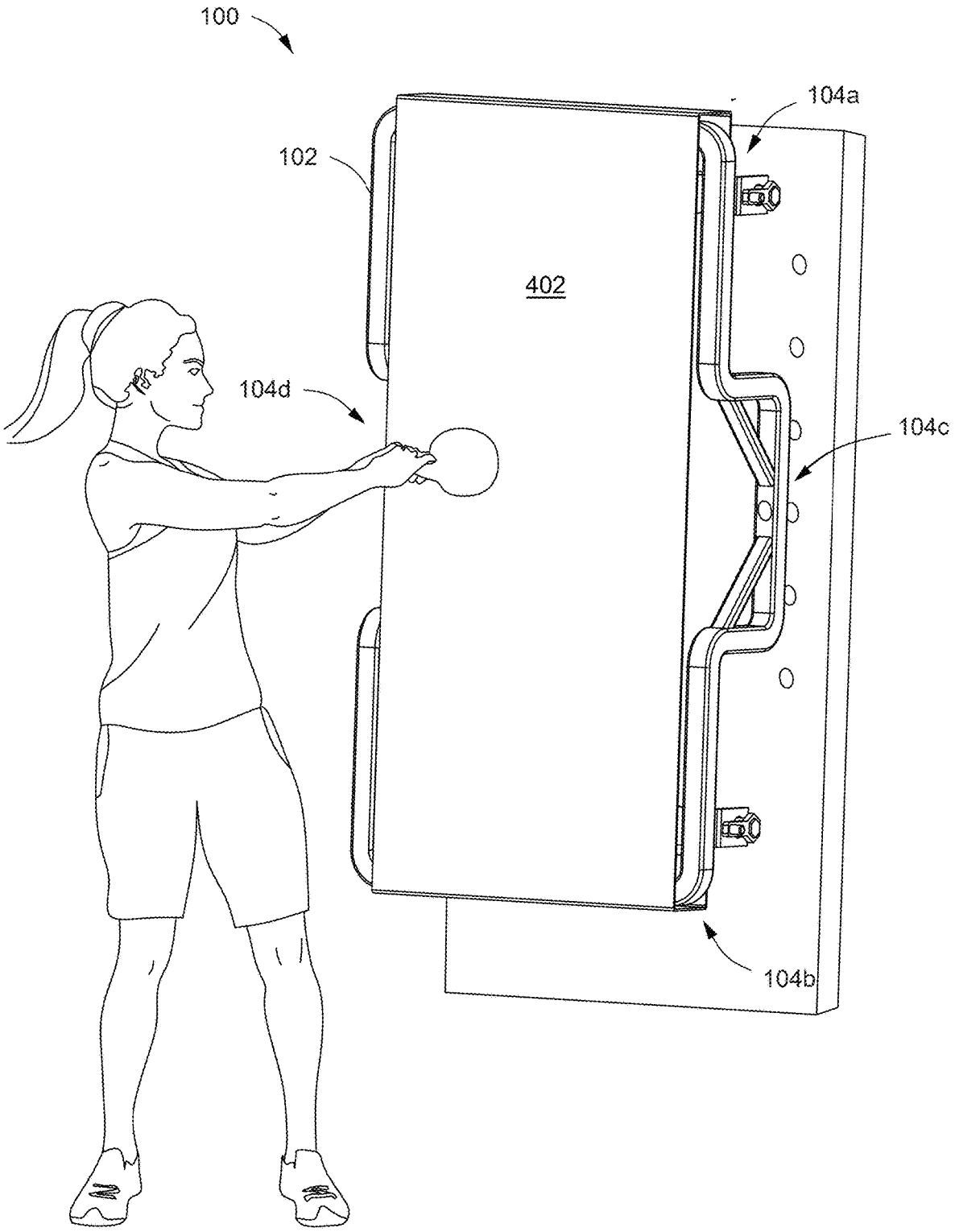
FIG. 4 is an illustration of a perspective view of person swinging her arms against a swing training assembly.

FIG. 3 is an illustration of a perspective view of a swing training assembly 100 coupled to support posts 302. The swing training assembly 100 includes a frame 102 and a base 304. The frame 102 has a first frame portion 104*a*, a second frame portion 104*b*, a third frame portion 104*c*, and a fourth frame portion 104*d*. Each frame portion 104 has the shape of an uppercase "U." Each frame portion 104 has a crossbar 108, a first arm 110*a*, and a second arm 110*b*. The base 304 is coupled to a crossbar 108 of the third frame portion 104*c* and to a crossbar 108 of the fourth frame portion 104*d*. The base 304 is coupled the support posts 302. Lock pins (not shown) may be inserted through respective apertures in the base 304 and respective apertures in the support posts 302 to hold the base 304 against the support posts 302.

Referring to FIGS. 1-4, a user may train with a swing training assembly 100 by first mounting the swing training assembly 100 onto a wall (see FIG. 1A) or one or more support posts (see FIG. 3). The user may adjust the height of mounting for the swing training assembly 100 by aligning apertures in a crossbar 108 of the third frame portion 104*c* and in a crossbar 108 of the fourth frame portion 104*d* with respective apertures in the wall. Next, the user may insert lock pins (not shown) through apertures in the frame portions 104*c*, 104*d* and apertures in the wall to hold the swing training assembly 100 in place.

Then, the user may turn a handle 210 of a ratchet 202 to cause a drum 206 to rotate clockwise. Because an end portion of a band 402 is disposed in an aperture 218 of the drum 206, turning the drum 206 causes portions of the band 402 to wrap around the drum and the end portion of the band 402. The more the band 402 wraps around the drum 206 the more tension is exerted on a middle portion of the band 402. More tension on the middle portion of the band 402 cause objects, e.g., weights or human arms, when struck onto the middle portion, to rebound more off the middle portion.

Once the user has tightened the band to a desired tension, the user may stand lateral to the swing training assembly 100 so that the user positioned to its right side. The user is positioned in a direction perpendicular to the planar surface of the band 402. In other words, the swing training assembly 100 would be disposed to the left of the user while the user is facing forward. While holding a weight, e.g., dumbbell or kettlebell, with one or both hands, the user may swing the weight from her right side to her left side towards the middle portion of the band 402. The side-to-side swinging motion is referred to as a lateral swing.

The momentum of the swung weight against the middle portion of the band 402 would cause the middle portion to stretch in conformance to the force of the weight. The middle portion of the band 402 would stretch towards the crossbar 108 of the third frame portion 104*c* and the crossbar 108 of the fourth frame portion 104*d*. Because the fourth frame portion 104*d* has a U-shape, a portion of the user's arms may travel a distance through an open side of the fourth frame portion 104*d*. In other words, a portion of the user's arms may be disposed between a first arm 108*a* and a second arm 108*b* of the fourth frame portion 104*d* after passing through the fourth side of the fourth frame portion. The benefit of the U-shaped frame portion 104*d* is that the user's arms can safely impact against middle band portion of the band 402 without striking any part of the frame 102.

The tension on the middle portion of the band 402 will cause the middle portion to resist the user's swinging motion. Because the band 402 is elastic, it will stretch in response to the forward motion of the weight being swung. As the forward motion of the weight stops, the stretched middle portion will rebound and cause the weight to rebound as well. The user must resist the rebound of the weight and try to move the weight in the forward direction until the weight rests on the band 402. The user's resistance to the rebound of the weight helps to develop the user's swing strength and coordination.

The user may repeat the exercise by standing on the left side of the swing training assembly 100. The user may then laterally swing the weight from her left side to her right side.

What is claimed as the invention is:

1. A method of swing training, comprising:
providing a swing training assembly that comprises:
a frame that comprises:
a first frame portion disposed on a first plane, the first plane having a front side and a rear side;
a second frame portion that is coplanar with the first frame portion;
a third frame portion coupled to the first frame portion and the second frame portion; and
a fourth frame portion coupled to the first frame portion and the second frame portion, the fourth frame portion having a U-shape; and
a band having a first band portion coupled to the first frame portion, a second band portion coupled to the second frame portion, and a middle band portion extending from the first frame portion to the second frame portion;
swinging a human arm laterally against the middle band portion; and
disposing a portion of the human arm within the fourth frame portion.

2. The method of claim 1, wherein the fourth frame portion is adjacent to the rear side of the first plane.

3. The method of claim 1, wherein the fourth frame portion is open at the middle band portion.

4. The method of claim 1, wherein a distance between the third frame portion and the fourth frame portion is less than or equal to a width of the first frame portion or the second frame portion.

5. The method of claim 1, wherein a distance between the first frame portion and the second frame portion is greater than or equal to a width of the fourth frame portion or the third frame portion.

6. The method of claim 1, further comprising a ratchet coupled to the first frame portion or the second frame portion.

7. The method of claim 1, wherein the band further comprises a second portion coupled to a ratchet that is coupled to the frame.

8. The method of claim 1, wherein the middle band portion extends from the first frame portion to the second frame portion.

9. The method of claim 1, wherein the middle band portion is adjacent to an open side of the fourth frame portion.

10. The method of claim 1, wherein the fourth frame portion comprises:
a first arm;
a second arm parallel to the first arm;
a crossbar coupled to the first arm and the second arm;
a first strut coupled to the first arm and the crossbar; and
a second strut coupled to the second arm and the crossbar.

11. A method of swing training, comprising:
providing a swing training assembly that comprises:
a frame that comprises:
a first frame portion disposed on a first plane, wherein the first plane has a front side and a rear side;
a second frame portion that is coplanar with the first frame portion;
a third frame portion coupled to the first frame portion and the second frame portion; and
a fourth frame portion disposed adjacent to the rear side of the first plane, the fourth frame portion having a U-shape portion; and
a band extending at least from the first frame portion to the second frame portion;
swinging a human arm laterally against the band; and
disposing a portion of the human arm within the U-shape portion.

12. The method of claim 11, wherein the fourth frame portion is coupled to the first frame portion and the second frame portion.

13. The method of claim 11, wherein the fourth frame portion is open adjacent to the band.

14. The method of claim 11, wherein the U-shape portion comprises:
a crossbar having a first crossbar end and a second crossbar end;
a first arm coupled to the first crossbar end and perpendicular to the crossbar; and
a second arm coupled to the second crossbar end and parallel to the first arm.

15. A method of swing training, comprising:
providing a swing training assembly that comprises:
a frame having a front side and a rear side, the frame comprising:
a first frame portion having a first frame crossbar, a first frame first arm perpendicular to the first frame crossbar, a first frame second arm perpendicular to the first frame crossbar;
a second frame portion having a second frame crossbar parallel to the first frame crossbar, a second frame first arm extending towards the first frame first arm, and a second frame second arm extending towards the first frame second arm;
a third frame portion disposed on the rear side of the frame and having a third frame crossbar extending a first distance from first frame portion to the second frame portion, a third frame first arm, a third frame second arm;
a fourth frame portion disposed on the rear side of the frame and having a fourth frame crossbar parallel to the third frame crossbar, a fourth frame first arm perpendicular to the fourth frame crossbar, a fourth frame second arm perpendicular to the fourth frame crossbar; and
a band having a first band portion coupled to the first frame crossbar, a second band portion coupled to the second frame crossbar, and a middle band portion extending from the first frame crossbar to the second frame crossbar;

swinging a human arm laterally against the middle band portion; and disposing a portion of the human arm between the fourth frame first arm and the fourth frame second arm.

16. The method of claim 15, wherein a distance between the third frame crossbar and the fourth frame crossbar is equal to the first distance.

17. The method of claim 15, wherein a distance between the first frame portion and the second frame portion is equal to or greater than a length of the fourth frame crossbar.

18. The method of claim 15, wherein the first band portion covers a portion of the first frame crossbar.

19. The method of claim 15, wherein the second band portion covers a portion of the second frame crossbar.

20. The method of claim 15, wherein the fourth frame portion is disposed on a first side of the frame and the middle band portion is disposed on a side of the frame, opposite the first side.

* * * * *